United States Patent [19]

Kato et al.

[11] 4,394,666

[45] Jul. 19, 1983

[54] TIME RECORDER

[75] Inventors: Hiroshi Kato, Atsugi; Hisataka Ato, Yokohama; Osamu Inagaki, Kawasaki; Hiroshi Matsuo, Yokohama, all of Japan

[73] Assignee: Amano Corporation, Yokohama, Japan

[21] Appl. No.: 264,207

[22] Filed: May 15, 1981

[30] Foreign Application Priority Data

May 20, 1980 [JP] Japan ..... 55-66611

[51] Int. Cl.[3] ..... G07C 1/06

[52] U.S. Cl. ..... 346/82

[58] Field of Search ..... 346/80-86; 235/377, 432, 487

[56] References Cited

U.S. PATENT DOCUMENTS 3,878,516 4/1975 Sato ..... 346/82

3,894,215 7/1975 Lotter et al. ..... 346/82 X 4,056,711 11/1977 Lamar ..... 235/487 X 4,270,043 5/1981 Baxter et al. ..... 346/86 X

*Primary Examiner*—Donald A. Griffin

*Attorney, Agent, or Firm*—Cushman, Darby & Cushman

[57] ABSTRACT

A time recorder comprising, in combination, read-out means for reading out a personal code shown on a time card inserted; print line number storage means provided correspondingly to each personal code for storing data expressing a print line number on the time card; positioning control means for reading out the data from said print line number storage means corresponding to a personal code previously read out at the time of insertion of the time card, and for positioning a print line of the time card in conformity with said data; and data update means for updating data in said print line number storage means in accordance with predetermined criteria.

9 Claims, 4 Drawing Figures

32
1
7
4
5
3
9
2
6
12
11

RAM
Clock register CK
Personal data memory
1 F1 C1
2 F2 C2
n Fn Cn
Transmitting buffer SB
22
ROM
21
Modulator demodulator
40
INT
Key input device
30
Indicating device
32
Interface circuit
31
INT
CPU
20
AB
DB
CB
INT
Clock circuit
25
Interface circuit
27
Card detector
7
Card code reader
9
Card line position detector
11
Card feed motor
5
Original point detector
26
Printer scanning motor
28
Print magnet
29

TIME RECORDER

BACKGROUND OF THE INVENTION

This invention relates to a time recorder to perform the automatic positioning control of print lines independently for each individual time card.

As well known, in many ordinary time recorders, a print line-positioning mechanism for determining a particular line of time card inserted, on which the time of day will be printed, is driven every time when a certain predetermined time (this is also called "line switching time") is reached, and the daily print location of the print line of the time card is updated by one line everyday.

That is, the time of arrival at and the time of departure from the place of work and so forth are all printed on the same line of a time card inserted in a particular day. This method of control for the print line is very suited to those places of business where each and every worker will come only once a day to and depart only once a day from the place of work.

However, the conventional time recorders stated above are not able to correctly record the work data of each employee on the time card if, in a certain place of work, the pattern of work of each worker is different from those of others; for instance, some person has to come to his place of work more than twice a day or some person has to stay in his place of work for more than 2 days between his arrival to and departure from his place of work.

For the place of work where the job contents of each worker cannot be uniformly processed on the daily basis, certain types of time recorders described below have been conventionally available. That is, a certain type of time recorder has a marker for showing the print complete mark (with a punched hole or printed character) to indicate the last line printed on time card as the printing of the times of arrival at and departure from the place of work progresses, and also has a mark sensor for detecting said print complete mark of time card inserted. And this time recorder will perform the print positioning for the time card, basing upon the signal detected by the mark sensor.

Some of the shortcomings of this kind of time recorders are that their costs are high since said marker and mark sensor are used only for the positioning control of the print line number and that erroneous operation easily occurs because of the stain or scratch on card if said marker and mark sensor have been simplified to reduce the cost. Naturally, their reliability can be greatly improved by using a control method adopting a relatively sophisticated error correcting code, but this will result in a complicated control system containing said marker and mark sensor and a great increase in cost.

SUMMARY OF THE INVENTION

The primary object of the present invention is to provide a time recorder capable of allowing an independent print line positioning control for each individual time recorder.

Another object of this invention is to provide a time recorder well suited to the work data control system capable of providing various work data related to such as overtime work, coming late, and leaving earlier for each person, and of totaling and storing such data.

It is another object of the present invention to provide a time recorder suited to the work data control system comprising a time recorder having a built-in microcomputer which is able to grasp, sum and store the work data for each worker basing upon the time of day where a time card is inserted.

Another object of the present invention is to provide a time recorder of simple construction that can be manufactured economically.

Another object of this invention is to provide a time recorder capable of allowing the independent print line positioning control for each individual time card and, at the same time, of allowing the print column positioning control.

Other and further objects of this invention will become obvious upon an understanding of the illustrative embodiments about to be described or will be indicated in the appended claims, and various advantage not referred to herein will occur to one skilled in the art upon employment of the invention in practice.

DETAILED DESCRIPTION OF THE INVENTION

Figure 1:
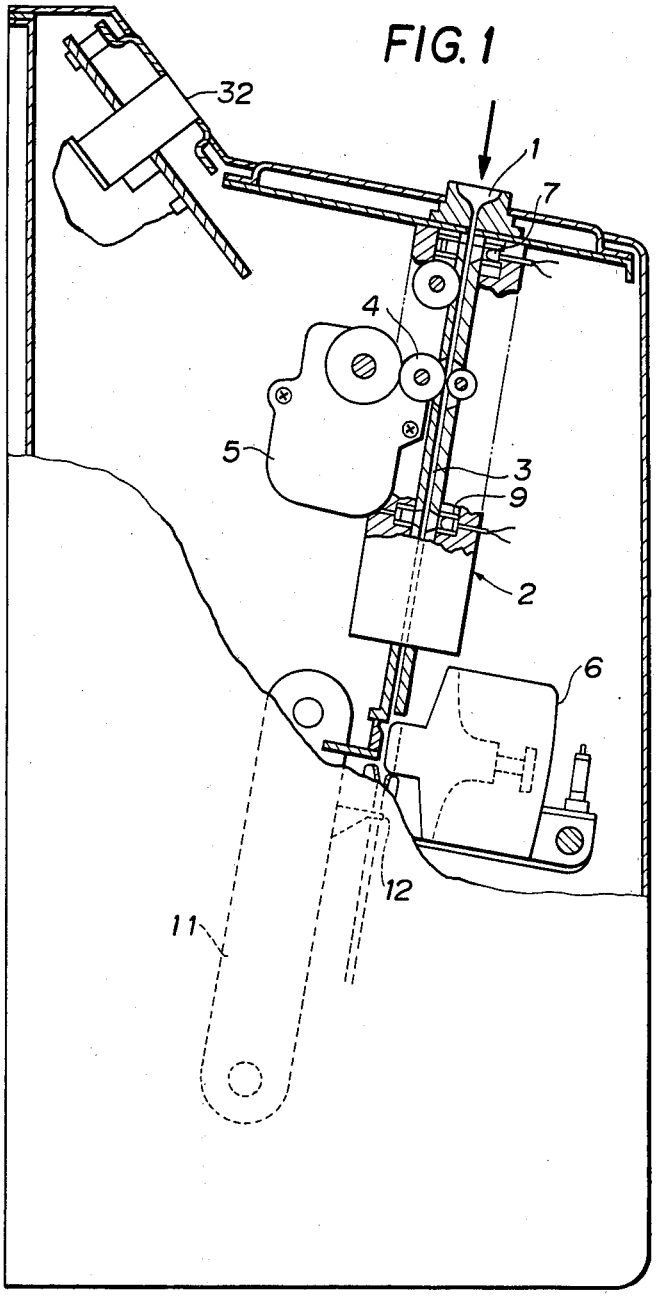
FIG. 1 is a partial section showing the construction of card insertion assembly and printer assembly of the time recorder, embodying the invention.
Figure 2:
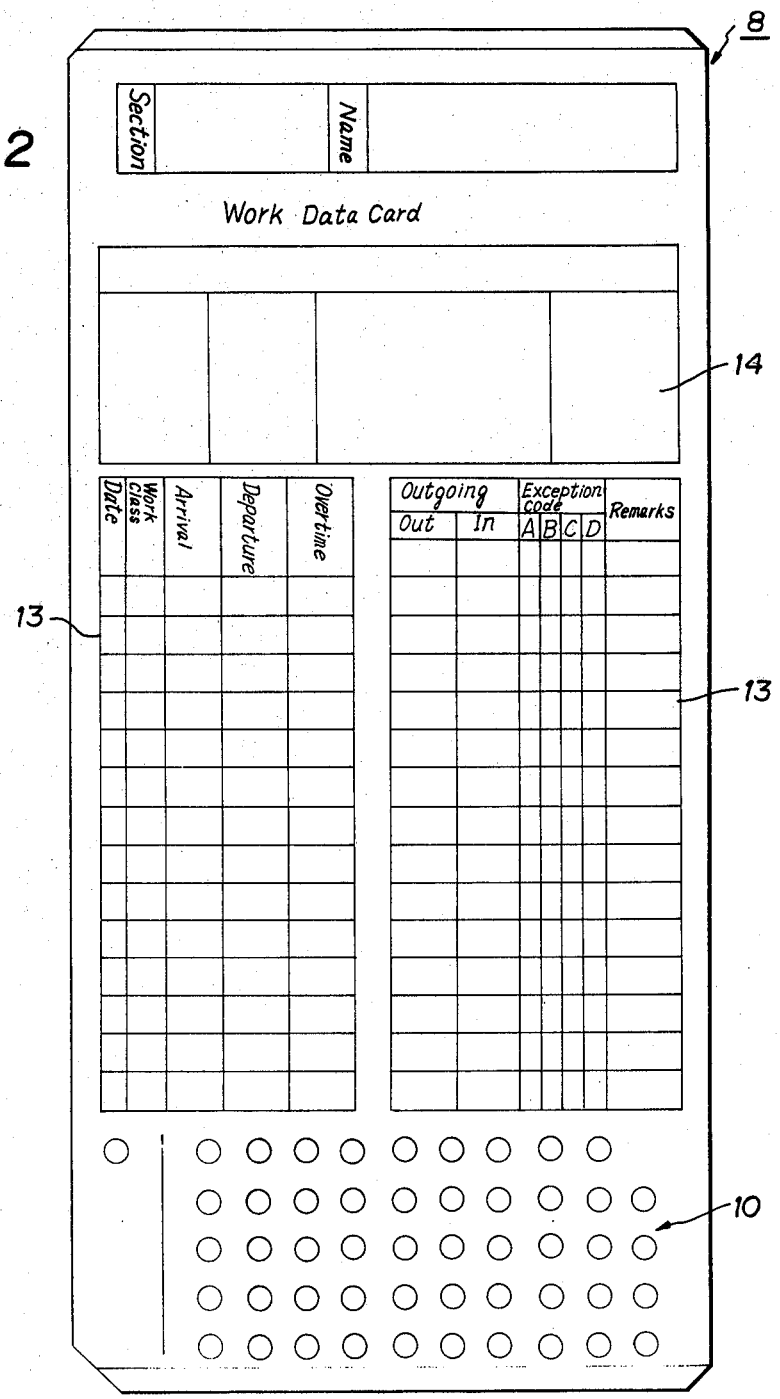
FIG. 2 is a view of time card to be used for the time recorder of the present invention.

FIG. 1 shows the construction of card insertion assembly and printer assembly of the time recorder of the present invention. Referring to FIG. 1, a card pocket 1 (card inlet), a card guide 2 having a guide slot 3 continuing to the card pocket 1, a card feed roller 4 driven by a card feed motor 5, and wire impact type dot printer 6 are indicated. Also, a card detector 7 consisting of a set of light-illminating and sensing elements oppositely located to each other at both sides of the guide slot 3 in the upper portion of the card guide will produce a card detection signal when a time card 8 shown in FIG. 2 is inserted from the card pocket 1 and the light in the gap between the light-illuminating and sensing elements is blocked. A code reader 9 for reading out the personal code recorded in the form of punched hole on a punch code zone 10 at the bottom of card 8 will consist of plural sets of pairs of light-illuminating and sensing elements located oppositely at both sides of the guide slot 3. A card line position detector 11 for detecting the location of the card 8 with respect to the printer 6 and for determining the location of print line of the card 8 will comprise a movable piece 12 capable of moving up and down if contacted by the bottom of said card 8 introduced into the guide slot 3 by the card feed motor 5, and a mechanism for detecting the amount of drop of the movable piece 12 from the original point.

As indicated in FIG. 2, a work data printing zone 13 is located and shown in the central portion of the time card 8. This printing zone 13 is divided into many rows by horizontal dividing lines, and each row (or line) is also divided by the vertical dividing lines into the printing columns of "date", "time of arrival" and "time of departure" and into a marking column called "remarks".

Figure 3:
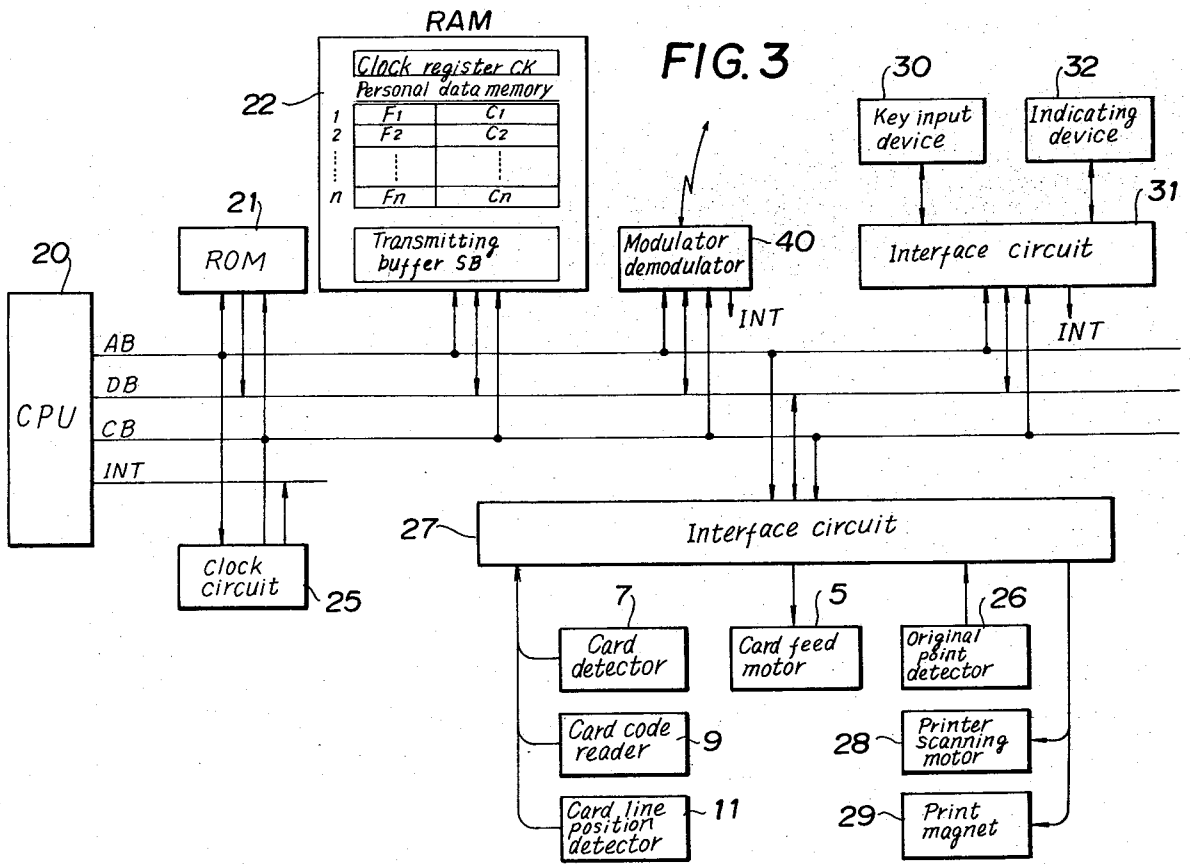
FIG. 3 is a block diagram showing the electrical configuration of the time recorder of the present invention.

Now, the electrical configuration of the time recorder of this invention will be described hereinafter by referring to the block diagram of FIG. 3. This time recorder mainly consists of a so-called microcomputer including a central processing unit 20 (this is a so-called microprocessor and abbreviated as CPU 20 hereinafter), its address bus AB, data bus DB, control bus CB, and interruption signal line INT.

The CPU 20 will control each portion of this equipment described hereinafter by sequentially executing the program stored in a read-only IC memory 21. During this time, a read-write IC memory 22 (this is abbreviated as RAM 22 hereinafter) is used as a temporary storage area for various kinds of control data and work data as described later.

A clock circuit 25 comprises an oscillator for generating reference signal for time processing, a counter and so forth, applies the pulse signal with 1-minute period (this is called "1-minute pulse") as an interruption signal to the CPU 20, stores the period of time of service interruption of its main power source, and is capable of reading the period of time of this service interruption by means of CPU 20 after the recovery from the power failure.

Each signal detected at a detector 26 for detecting the returning to the original point of said card detector 7, card code reader 9, card line position detector 11, and the head of printer 6 can be read out by the CPU 20 through an interface circuit 27. Also, said card feed motor 5, a motor 28 for scanning the head of the printer 6 in the direction of width of time card 8, and a print magnet 29 for driving the dot wires of the printer 6 are all controlled through the interface circuit 27 by the CPU 20. In addition, a proper key input device 30 and an indicating device 32 are connected through the interface circuit 31 to the CPU 20, so that an operation for rewriting the data in RAM 22 can be performed by this key input device 30 and also the time data (month, day, hour and minute) generated in CPU 20 are indicated on the indicating device 32.

Also, a modulator-demodulator 40 is provided for connecting this time recorder to an external computer through a predetermined transmission line, through which the work data of each person generated at the time recorder are transmitted through the modulator-demodulator 40 to the external computer, summed and stored there for each person after processing them in various ways.

Now, the principal elements of data stored in the RAM 22 will be described herein-after. An area called clock register CK is provided in this RAM 22, and the time data (month, day, hour and minute) updated every minute in response to the 1-minute pulses from said clock circuit 25 are stored in this clock register CK. Also, in an area called "data memory for individual person" in RAM 22, arrival-departure state flag F's ($F_1$ to $F_n$) and print line number counter C's ($C_1$ to $C_n$) are provided respectively in response to the addresses (1 to n) assigned for each of the personal code. After the time card 8 for a particular person was inserted the arrival-departure state flag F expresses whether the time of day when this card was inserted should be printed in the time of arrival column of the printing zone 13 or in the time of departure column. Also, the data expressing the line number in the printing zone in which the time of day is to be printed after an insertion of time card for a particular person will be stored in the print line number counter C 12. Also, a transmitting buffer SB for temporarily storing data to be transmitted through modulator-demodulator 40 to the external computer is provided in RAM 22.

Now, the operation of time recorder of the present invention will be described in detail by referring to the flowchart shown in FIG. 4. The flowchart shown in FIG. 4 indicates the outline of system program stored in the ROM 21 which prescribes the operation of CPU 20. This flowchart indicates the main routines. If the 1-minute pulses from the clock circuit 25 are applied to CPU 20, an interruption routine is executed, the time data in the clock register CK of RAM 22 are updated, the updated time data are indicated on the indicating device 32, and then the flow will return to the main routines.

Figure 4:
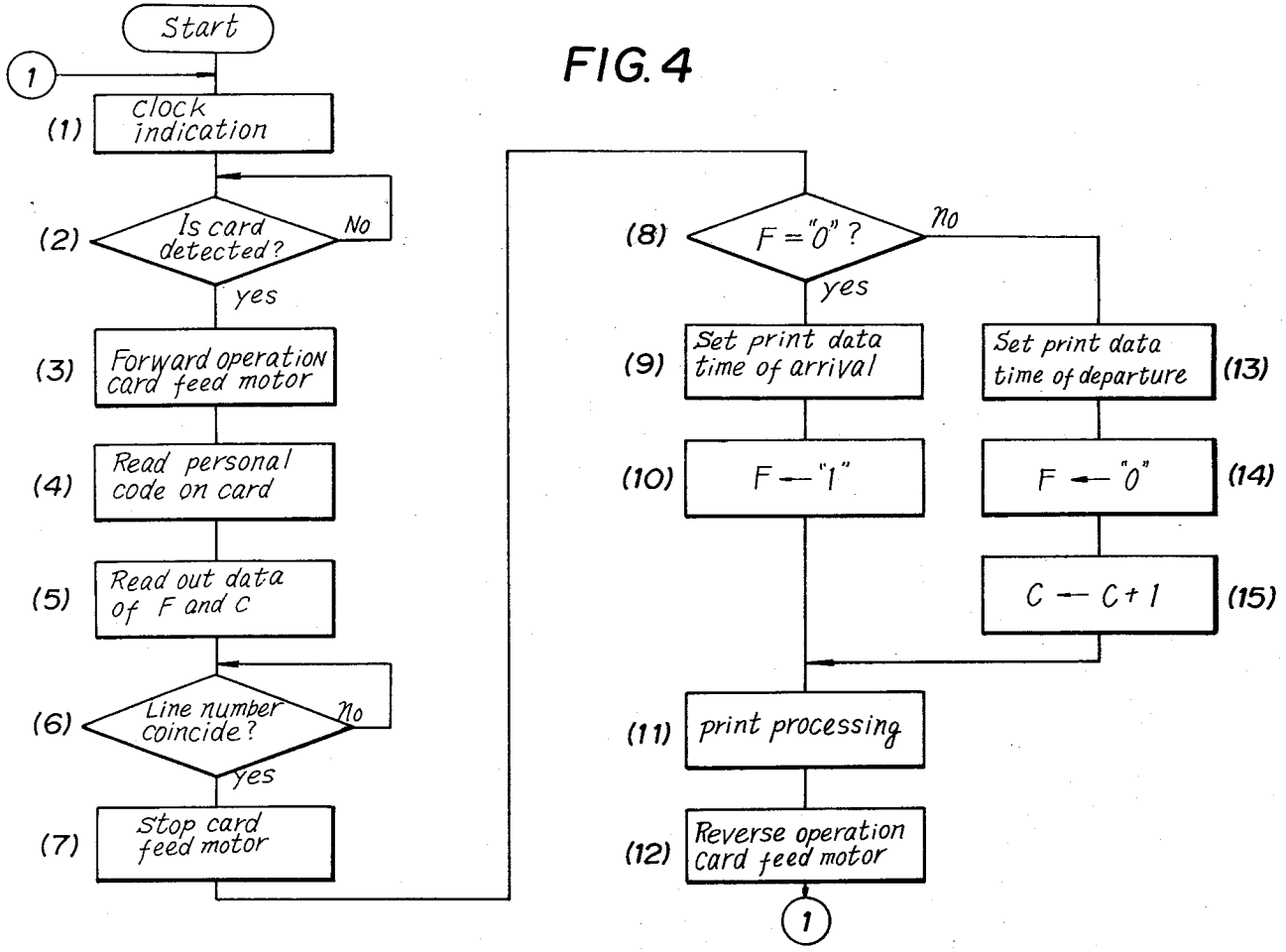
FIG. 4 is a flowchart indicating the operating procedure of CPU 20 prescribed by the program in ROM 21 shown in FIG. 3.

In FIG. 4, the current time data in said clock register CK are supplied to and indicated on the indicating device 32 during the first routine (1). In the subsequent routine (2), the output from said card detector 7 is checked to determine whether the time card 8 has been inserted to the card pocket 1. This routine (2) is repeated until the insertion of card 8 is detected. And if the insertion of card 8 is detected, the operation will step forward to the routine (3), and the card feed motor 5 is started in the forward direction. Then, the time card 8 inserted to the card pocket 1 is sucked into the guide slot 3 by the feed roller 4. In subsequent routine (4), the output from said code reader 9 is used, and then the personal code recorded in the punch code zone 10 of card 8 previously sucked into the guide slot 3 and moved to the reader 9 will be read out.

In subsequent routine (5), the data of the print line number counter C corresponding to the personal code read out from the time card 8 will be read out from the said personal data memory. In subsequent routine (6), the output from the card line position detector 11 is checked, the print line position of time card 8 being drawn deeply into the guide slot 3 by the feed motor 5 is sequentially detected. and also the current print line position is checked to determine whether this position coincides with the data read out from said print line number counter C. The routine (6) is repeated until the print line numbers coincide each other, the operation steps to next routine (7) if a coincidence occurs, and then the card feed motor 5 is stopped. Then, the time card 8 is positioned with respect to the printer 6 in accordance with the print line number data stored in the print line number counter C corresponding to the personal code for the card, and this time card is stopped.

In the subsequent routine (8), the arrival-departure state flag F corresponding to said personal code is checked to judge whether this flag has become "0" which expresses the state of "arrival queuing". If this flag F has been judged to be "0" or YES, the operation will propress to the routine (9), the current insertion of card is recognized to be made by the arrival of worker come to work, and the print data are prepared in RAM 22. That is, the month and day data in the clock register CK are set as print data corresponding to the "date" column in the printing zone 13 of card 8, hour and minute data in the clock register CK are set as print data corresponding to "time of arrival" column, and the data area corresponding to "time of departure" is left blank. In the subsequent routine (10), the arrival-departure state flag F corresponding to said personal code is set to "1" which expresses the "departure queuing".

In the subsequent routine (11), the print data prepared in the routine (9) are printed on said line position of the time card 8 by the printer 6. That is, the printer scanning motor 28 is driven to move the printer head in the width direction of card 8, and the print magnet 29 is sequentially driven in accordance with the print data to print the corresponding data on the predetermined column in the printing zone 13. In case of arrival in the above routine, the date and time of day when the card is inserted will be printed on "date" column and "time of arrival" column respectively in the printing zone 13.

Upon completion of printing, the operation progresses to routine (12), the card feed motor 5 is rotated reversely, the time card 8 is ejected from the card pocket 1, and the operation returns to routine (1).

If the personal code of time card 8, on which the predetermined data are printed in "date" column and "time of arrival" column on printing line number "j", is expressed by "i", this card having personal code "i" will be processed as described below when it is inserted again to the card pocket 1 at the time of departure of worker. That is, routines (2), (3), (4), (5), (6) and (7) are executed in the order listed and time card 8 is positioned for printing. However, in this case, the data of the print line number counter Ci corresponding to the personal code "i" are the same as those of time of arrival stated previously, so that the card is positioned in the same manner as time of arrival when the print line number j of the printing zone 13 was set for the printer 6.

In subsequent routine (8), the arrival-departure flag Fi corresponding to the personal code "i" has been set to "1", so that an judgement of NO is made and the operation progresses to routine (13).

In routine (13), the hour and minute data in the clock register CK are set as print data corresponding to the "time of departure" column, and the area corresponding to "date" and "time of arrival" columns is left blank. In subsequent routine (14), the arrival-departure state flag F corresponding to the personal code "i" will be set to "0".

In subsequent routine (15), "1" is added to the data of print line number counter Ci corresponding to the personal code "i". Then, the operation progresses from routine (11) to routine (12). Thus, the time of card received is printed in the "time of departure" column with print line number j of time card 8, and the card is ejected.

In this case, if the time card 8 with said personal code "i" is inserted, the data of corresponding print line number counter Ci will be already updated to "j+1" and corresponding arrival-departure state flag Fi will be already set to "0", so that the processing stated above will be performed and then the date and time of card received are printed in the "date" and "time of arrival" columns on the print line number "j+1" of card 8. Then, this card is ejected.

Basing upon each arrival-departure state flag F of personal data memory and data of the print line number counter C, the positioning of the print line number of each time card 8 and the discrimination of arrival-departure (to determine whether arrival or departure) will be performed as stated above. And the data of print line number counter C are updated when the corresponding time card 8 is inserted at the time of departure, and the time of arrival in a subsequent working day will be printed on the line immediately below line on which previous printing was made.

Though not indicated in the flowchart of FIG. 4, the personal code and time of card received read out during routine (9) or (13) after the discrimination of arrival-departure in routine (8), for example, are stored as a pair of data in the transmitting buffer SB in RAM 22. Thus, the data in the transmitting buffer SB are transmitted to external computer by means of interruption process in accordance with the predetermined procedure of transmission control in connection with external computer.

Now, another embodiment of the present invention will be described below. In the embodiment stated above, the print line number counter C is updated at the time of departure, but this updating can be also performed at the time of arrival of worker but, in this case, positioning control of card 8 must be done after updating. Also in the foregoing embodiment, though the "time of arrival" and "time of departure" are printed on the same line in different column of the card, they can be also printed on the different lines in the same column as long as the updating of said print line number counter C is performed during both the time of arrival and time of departure. In addition, instead of performing the complicated arithmetic operation for work data and of storing results of summation by using an external computer, a data processing unit capable of performing the same arithmetic and storing operations may be installed in the time recorder. In this case, the form of time card is not limited to the foregoing embodiment, and it is of course possible to provide other various kinds of print columns such as "coming late", "leaving earlier" or "overtime work".

According to the time recorder of the present invention stated above in detail, it is not required to use such expensive mechanisms exclusively for positioning the print line numbers as marker for showing the print complete mark on each time card or detector for reading out the marks, which were used in conventional time recorders as stated previously. Therefore, this invention is able to realize the highly reliable positioning control of the print line numbers for each worker with low cost by utilizing inexpensive and highly reliable storing means such as IC memory.

As many apparently widely different embodiments of this invention may be made without departing from the spirit and scope thereof, it is to be understood that the invention is not limited to the specific embodiments thereof except as defined in the appended claims.

What we claim is:

1. A time recorder capable of accepting a time card having a personal code of each individual time card user, of printing predetermined time data, for example, the time of day of acceptance of said time card on a predetermined line of said time card, and of ejecting said time card after said time is printed thereon, said time recorder comprising:

means defining a predetermined path of time card conveyance having an inlet opening into which said time card is at least partially manually inserted;

reading means for reading said personal code when said time card is inserted into said predetermined path;

storage means for electronically storing at least print line number data corresponding to said personal code read by said reading means;

printing means for printing said predetermined time data upon said time card;

motor means rotatable in a first direction for conveying said time card along said predetermined path after said time card is at least partially manually inserted into said inlet opening, and rotatable in a second direction opposite to said first direction for ejecting said time card from said time recorder after said predetermined time data is printed upon said time card; and position determining means for determining the position of said time card relative said printing means so that said predetermined time data is printed upon a predetermined print line number of said time card, said position determining means including movable means for contacting and being displaceable with the bottom edge of said time card as said time card is conveyed through a portion of said predetermined path by said motor means, position signal generating means for generating a position signal responsive to said movable means, and comparator means for comparing said position signal and said stored print line number data and for stopping said motor means when said position signal is equal to said stored print line number data.

2. The time recorder described in claim 1, being capable of being applied to a work data control system capable of finding, summing and storing for each person the various kinds of work data related to each worker's overtime work, coming late, leaving earlier and so forth.

3. The time recorder described in claim 2, said work data control system being built in said time recorder and being comprised of microcomputer capable of finding, summing and storing for each person the work data with reference to the time of day of acceptance of the time card.

4. The time recorder described in claim 2, said work data/control system being comprised of an external computer capable of finding, summing and storing for each person the work data with reference to the time of day of acceptance of time card transmitted from said time recorder.

5. The time recorder described in either one of claims 1, 2, 3 or 4, said print line number storage means being comprised of an IC memory.

6. A time recorder as in claim 1 further comprising means for updating said print line number data stored in said storage means corresponding to said personal code read by said reading means whereby said predetermined time data is printed upon a print line number successively following said first mentioned print line number of said time card when said individual user reinserts said time card having said personal code.

7. The time recorder described in claim 6, said print line number storage means being stored with said print line number data in addition to arrival-departure data for each individual person, said positioning control means being arranged so as to allow the print line positioning of time card as well as print column positioning on the basis of said arrival-departure data, and said data update control means being arranged so as to allow the updating of said print line number data only upon acceptance of a card corresponding to either arrival or departure of worker.

8. The time recorder described in claim 6, said data update control means being arranged so as to allow to update said print line number data every time after acceptance of each card.

9. A time recorder as in claim 1 or 6 wherein said printing means includes positioning means for laterally positioning said printing means along said printing line so that at least two discrete columns are printable on said print line number.

* * * * *